United States Patent [19]

Theurer

[11] Patent Number: 4,691,565

[45] Date of Patent: Sep. 8, 1987

[54] MOBILE MACHINE FOR MEASURING TRACK PARAMETERS

[75] Inventor: Josef Theurer, Vienna, Austria

[73] Assignee: Franz Plasser Bahnbaumaschinen-Industriegesellschaft m.b.H., Vienna, Austria

[21] Appl. No.: 863,884

[22] Filed: May 16, 1986

[30] Foreign Application Priority Data

Aug. 22, 1985 [EP] European Pat. Off. ..... 85890188.7

[51] Int. Cl.[4] ..... G01B 5/20

[52] U.S. Cl. ..... 73/146; 33/287; 33/DIG. 21

[58] Field of Search ..... 73/146; 33/287, DIG. 21

[56] References Cited

U.S. PATENT DOCUMENTS

| | | | |
|---|---|---|---|
| 3,144,834 | 8/1964 | Stewart | 104/12 |
| 3,643,503 | 2/1972 | Plasser et al. | 73/146 |
| 3,706,284 | 12/1972 | Plasser et al. | 33/46 AT |
| 3,750,299 | 8/1973 | Plasser et al. | 33/287 |
| 3,821,933 | 7/1974 | Plasser et al. | 33/287 |
| 3,828,440 | 8/1974 | Plasser et al. | 33/144 |
| 4,165,693 | 8/1979 | Theurer | 104/12 |
| 4,356,771 | 11/1982 | Theurer | 33/287 |
| 4,391,134 | 7/1983 | Theurer | 73/146 |
| 4,490,038 | 12/1984 | Theurer et al. | 33/338 |

FOREIGN PATENT DOCUMENTS 256159 12/1966 Austria .

OTHER PUBLICATIONS

Eisenbahntechnische Rundschau, vol. 11, 1982, pp. 811–821.

*Primary Examiner*—Donald O. Woodiel
*Attorney, Agent, or Firm*—Kurt Kelman

[57] ABSTRACT

A mobile machine for measuring the position of a track and arranged for mobility on the track in an operating direction, comprising a machine frame having a front end in the operating direction, track reference measuring systems on the machine frame for determining different track parameters including the vertical and lateral position of the track, a laser beam receiver on the machine frame front end, and a self-propelled satellite bogie preciding the machine frame front end in the operating direction for mobility on an uncorrected section of the track in said direction, the bogie being equipped with a drive for propelling the bogie in said direction, and a laser beam emitter emitting a laser beam extending in at least one plane and projecting the laser beam on the receiver for continuously determining any deviations in an extended uncorrected track section from a desired one of said positions, the front end of the machine frame being arranged for receiving the satellite bogie and having a storage station whereinto, and wherefrom, the satellite bogie may be propelled, and the satellite bogie being constructed for being automatically propelled into, and from, the storage station and the front end of the machine frame.

12 Claims, 4 Drawing Figures

MOBILE MACHINE FOR MEASURING TRACK PARAMETERS

Figure 1:
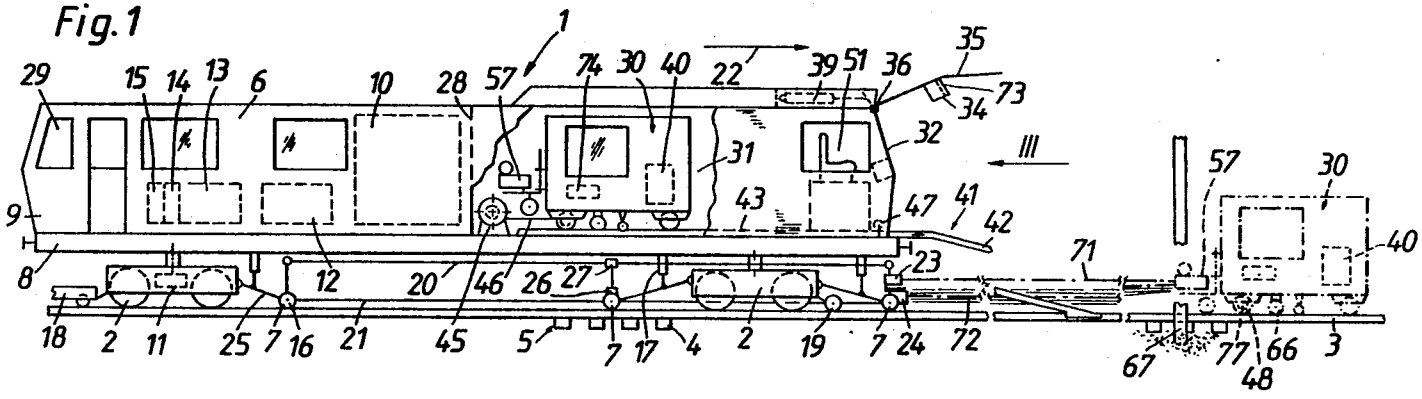

The present invention relates to a mobile machine for measuring and preferably recording track parameters, including the vertical and lateral position of the track, to enable the track position to be corrected. The mobile machine is arranged for mobility on the track in an operating direction and comprises a machine frame having a front end in the operating direction, track reference measuring systems on the machine frame for determining such track parameters as track level, line, twist, gage and cross level, such as found on conventional track measuring cars, the systems for determining the track level and line including a laser beam receiver means on the machine frame front end, and a self-propelled satellite bogie preceding the machine frame front end in the operating direction for mobility on an uncorrected section of the track in this direction, the bogie being equipped with a drive for propelling the bogie in this direction, and a laser beam emitter means emitting a laser beam extending in at least one plane and projecting the laser beam on the receiver means for continuously determining any deviations in an extended uncorrected track section from a desired one of the positions.

U.S. Pat. No. 3,706,284, dated Dec. 19, 1972, discloses a mobile machine of this type, which also comprises track leveling, lining and tamping means for correcting the track position. To monitor the leveling operation, the machine comprises a track level reference system comprised of a conical light bundle emitted by a light beam emitter mounted on a bogie preceding the machine frame and a light beam receiver mounted on the machine frame. This bogie is coupled to the machine frame by a spacing rod holding the bogie at a constant distance from the machine frame and is preceded by a second, self-propelled bogie which is preferably remote controlled by radio and carries a laser beam emitter for emitting a conical laser beam bundle. A second laser beam receiver is mounted on the machine frame in the range of the first-named laser beam receiver and receives the laser beam from the second emitter. In one embodiment, the laser beam emitter may be focussed on a fixed point alongside the track. After the track work has been completed at a given track section, the bogies preceding the machine frame must be manually lifted off the track by at least two workers and are hung on a hook provided at the front end of the machine frame whence they must be taken again and placed on the track before the next work stage is started. This requires great care for the very sensitive laser beam emitter when the bogie is handled, and it is a common practice to remove the laser beam emitter entirely before the bogie is hung up.

U.S. Pat. No. 3,821,933, dated July 2, 1974, discloses a track liner operating with a laser beam emitter and receiver. The laser beam emitter is mounted on a bogie preceding the liner and is rotatable about a vertical axis. The receiver is mounted on the front end of the liner and connected to its reference system, and the laser beam emitter and receiver are focussed on a fixed point of the track. After completing a lining operation, the liner is moved towards the laser beam emitter which is rotated to the extent required by the change in the track ordinate so that, before the next lining step, the laser beam receiver following the pivoting laser beam is in the desired position. In this machine, too, the bogie must be manually removed from the track, hung up on the liner and then be placed on the track again by the operating personnel.

The track leveling and tamping machine of Austrian patent No 256,159, dated Dec. 15, 1966, comprises a self-propelled bogie preceding the machine frame and holding a seat for an operator. A light beam emitter is mounted on the front end of the machine frame above each track rail and a respective light beam receiver is mounted on the bogie, the associated emitters and receivers being so interconnected that they are always in alignment. Again, the bogie must be manually removed from, and placed on, the track after and before each operation.

U.S. Pat. No. 4,490,038, dated Dec. 25, 1984, discloses a mobile apparatus for determining the lateral position of a railroad track with respect to an adjacent track without physical contact therewith. The distance is measured by a laser beam emitter and receiver having coincidental optical axes extending in a plane extending perpendicularly and transversely to the tracks, which is vertically adjustably mounted on a self-propelled track measuring carriage. The laser beam emitter and receiver is focussed on the closer one of the rails of the adjacent track and the distance is measured by making a number of measurements corresponding to the impulse frequency of the laser beam emitter and comparing these measurements with stored desired measurement values. This apparatus may be used for all sorts of distance measurements.

U.S. Pat. Nos. 3,643,503, dated Feb. 22, 1972, and No. 3,828,440, dated Aug. 13, 1974, disclose track measuring and recording cars for measuring and recording such track parameters as track level, line, twist, gage, superelevation and cross level, and the like. The measurements are taken under a load while the car continuously advances along the track to create the same conditions as occur when a train moves over the track. The cars are equipped with track sensors in the range of their wheel axles or swivel trucks. The cars have been used with great success in track maintenance work.

Finally, a new concept of automatically correcting track curves is described in detail in an article in Vol. 11, 1982, pages 811–821, of "Eisenbahntechnische Rundschau". In this operation, the reference system of the tamper, which carries track correction tools, is controlled by a laser beam which is positioned in relation to fixed points alongside the track. For this purpose, a laser beam emitter is mounted on a bogie preceding the tamper at a level of a fixed point preceding the tamper and is moved by an electronic measuring tape to a desired position in which the emitted beam focussed on a receiver on the tamper corresponds to a chord of the curve shown in a map of the track. The tamper is equipped with a memory and computer with a magnetic tape on which the previously established desired track parameters have been stored. Therefore, deviations of the track position determined by the laser beam installation can be immediately established and track corrections effected accordingly.

It is the primary object of this invention to provide a mobile machine for measuring the position of a track of the above-described type, which assures a high measuring accuracy while increasing the efficiency of the operation.

It is another object of the invention to provide an improved track position measuring method by operating such a machine.

In a mobile track position measuring machine of the first described type, the object is accomplished according to the present invention by arranging the front end of the machine frame for receiving the satellite bogie and having a storage station whereinto, and wherefrom, the satellite bogie may be propelled. The satellite bogie is constructed for being automatically propelled into, and from, the storage station and the front end of the machine frame. The front end of the machine frame defines a tunnel having a cross section corresponding at least to the cross section of the satellite bogie for receiving the satellite bogie and enabling the satellite bogie to move through the tunnel to and from the storage station.

This machine for the first time makes it possible to operate substantially non-stop for measuring an extended section of track. The self-propelled bogie which may be readily moved into and out of the machine frame enables the machine to increase the miles/hour operating capacity considerably since the intervals between passing trains can be used much more effectively because the bogie can be rapidly withdrawn when a measuring operation must be interrupted and/or the machine is moved from one site to another while it is as rapidly placed in operating position on the track to initiate a measuring operation. The use of laser beams enables the bogie to be spaced a relatively long distance from the machine frame so that the machine can be used for measuring long track sections with great efficiency while the machine frame continuously approaches the preceding bogie. In addition, the satellite bogie carrying the highly sensitive laser beam instruments is protected against the weather and other possible damage when it is loaded into the machine frame without any further protective measures and is held there in immediate readiness for the next measuring operation. When the satellite bogie is loaded on the machine frame, the entire machine can be readily coupled to a train for movement therewith to the next operating site. In other words, the entire machine permits simpler and more effective track measuring and correcting operations while making it possible to initiate and terminate such operations rapidly.

In the improved method of operating the machine, the satellite bogie is propelled out of the front end of the machine frame onto the uncorrected track section until it has reached an extended distance from the machine frame front end, the distance measuring laser beam emitter and receiver is operated together with the laser beam emitter means by remote control until the laser beam emitter and receiver has been focussed on a respective one of the fixed points alongside the uncorrected track section, the laser beams emitted by the laser beam emitter means on the bogie while the bogie is stopped are received by, and thereby focus, the laser beam receiver means on the machine frame, and the machine frame is continuously advanced towards the stopped bogie to obtain measuring data indicating the ordinate and the level, the continuously obtained measuring data are compared with comparative data indicating the desired data and the ascertained differential values are stored, the stopped bogie is propelled forwardly after the machine frame has approached the bogie and the above steps are repeated until the extended uncorrected track section has been measured, and the bogie is propelled by remote control back into the front end of the machine frame after the measurement of the extended uncorrected track section has been completed.

This method makes it possible to use even short intervals between passing trains in heavily-travelled track sections for making very accurate track position measurements to compare the measured track position with the desired track position determined by a track map. The satellite bogie can be rapidly moved into and out of the machine frame. In addition, when the machine is moved from a train depot to a working site over a long distance, the satellite bogie is stored in the machine frame which is capable of much higher speeds than the self-propelled bogie.

Figure 2:
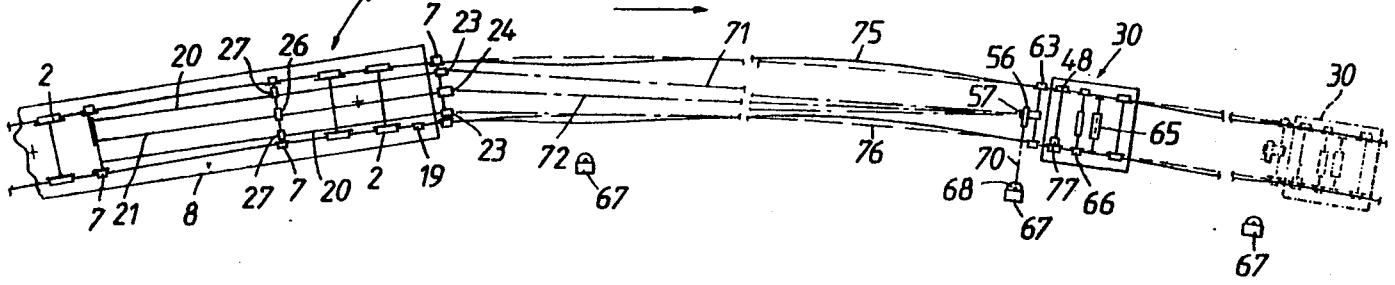
Figure 3:
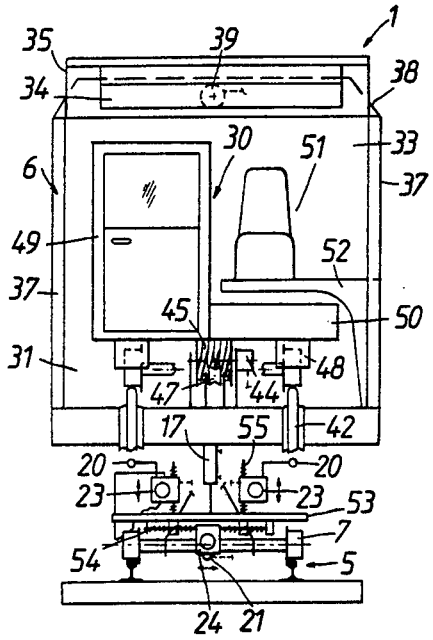
Figure 4:
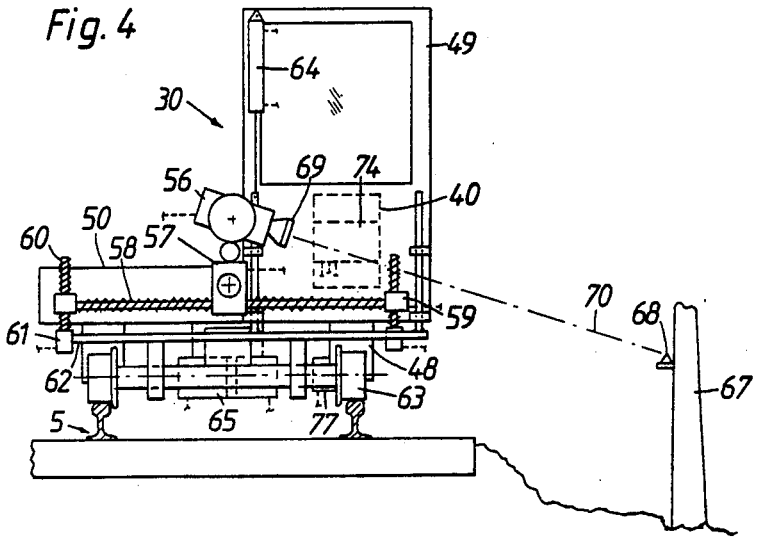

The above and other objects, advantages and features of this invention will become more apparent from the following detailed description of a now preferred embodiment thereof, taken in conjunction with the accompanying, partly schematic, drawing wherein FIG. 1 is a side elevational view of a track measuring and recording car embodying the mobile machine of the invention, showing the satellite bogie loaded in the storage station at the front end of the machine frame and the pivotal front door designed to open and close the machine frame front end pivoted into the open position;

FIG. 2 diagrammatically illustrates a top view of the machine of FIG. 1, with the satellite bogie propelled forwardly to a point at a considerable distance from the front end of the machine frame and focussed on a fixed track point;

FIG. 3 is an enlarged end view of the front end of the machine, as seen in the direction of arrow III of FIG. 1; and FIG. 4 is an enlarged end view of the satellite bogie, showing the laser beam emitter means and the distance measuring laser beam emitter and receiver on the bogie.

As seen in FIG. 1, mobile machine 1 for measuring the position of track 5 comprised of rails 3 fastened to ties 4 is arranged for mobility on track 5 in an operating direction indicated by arrow 22. The illustrated machine comprises track measuring and recording car 6 running on swivel trucks 2 and comprising sensors 7 for measuring the vertical and lateral position of the track and determining other track parameters, including the track twist, gage, superelevation and cross level, and others. The car comprises machine frame 8 of box-shaped construction 9 and having front end 32 in the operating direction. The car is equipped with power plant 10, drive 11 for moving the car along the track under the power provided by plant 10, electrical circuit and switching station 12 and computer 13 for processing and recording the measured track parameters. Sensors 7 mechanically receive the respective track parameters and the measured values are converted into electrical voltage signals which are transmitted to the computer. The desired track position parameters shown in a map of the track are stored as electrical voltages in electronic circuit 14 where they are compared with the voltage output signals of computer 13, and the differential values are stored in memory device 15. Sensors 7 are constituted by telescopic measuring axles carrying flanged sensing or measuring wheels 16 at their opposite ends, the flanges of the wheels being constantly pressed against the rail heads by pneumatic cylinders 17. Odometers 18, 19 are mounted on machine frame 8 at the front and rear ends thereof. The track reference measuring systems on the machine frame for determining the different track parameters further include measuring chords 20 respectively associated with each rail 3 and stretched between the two outermost sensors 7 for measuring the vertical position or level of the track and measuring chord 21 extending centrally therebetween for measuring the lateral position of line of the track. Laser beam receiver means 23, 24 on the machine frame front end comprise a pair of laser beam receivers 23, 23 and laser beam receiver 24, the rear ends of the measuring chords being attached directly to the axle of rear sensor 7 while the front ends of the measuring chords are affixed to laser beam receivers 23 and 24. The outermost as well as the centrally positioned sensors 7 are located in the range of swivel trucks 2 so that all measurements are effected under a load. The sensors are linked to the swivel trucks by rods 25 and may be lifted off track 5 by operation of pneumatic cylinders 17 when the machine is in transit to a working site. The centrally positioned sensor 7 has receiving element 26 engaging line measuring chord 21 and additional receiving elements 27, 27 engaging level measuring chords 20, 20. These elements receive the associated chords in a fork-like sensing member which has a rotary potentiometer transducer converting any change in the position of the chord into a corresponding electrical voltage signal and transmits this measuring signal to recording device 13.

Vertically extending separating wall 28 divides box car 6 substantially into a rear half housing power plant 10, electronic instrumentation 12–15 and an operator's cab 29, and front half 32. This front end of machine frame 8 is arranged for receiving satellite bogie 30 and has storage station 31 whereinto, and wherefrom, the satellite bogie may be propelled. It defines tunnel 33 in box-like construction 9 which has a cross section of a dimension corresponding to at least the dimension of the cross section of satellite bogie 30 for receiving the satellite bogie and enabling the satellite bogie to move through the tunnel to and from storage station 31. As shown in FIGS. 1 and 2, in operation satellite bogie 30 precedes machine frame front end 32 in the operating direction for mobility on an uncorrected section of the track in this direction, the bogie being equipped with drive 40 for propelling the bogie in this direction. Laser beam emitter means 57 emits a laser beam extending in at least one plane and projecting the laser beam on receiver means 23, 24 for continuously determining any deviations of an extended uncorrected track section from a desired one of the positions. The self-propelled bogie is constructed for being automatically propelled into, and from, storage station 31 and front end 32 of machine frame 8.

Such a track parameter measuring and recording car for the first time enables a continuous, efficient and accurate measurement of track position parameters to be effected over extended track sections with respect to a desired position indicated on a track map while, at the same time, various other track parameters, such as twist, cross level and others, may be measured without hindrance so that the entire track geometry may be surveyed at one and the same time. The electronic comparator and memory devices enable any differences between the desired parameters stored on a magnetic tape, for example, and the measured parameters to be rapidly and exactly determined, and the differential parameters to be stored for retrieval in a subsequent track correction operation. For example, these differential parameters may be stored on a magnetic tape and this tape is used in the control of a track leveling, lining and tamping machine designed to level and line the track.

A fully automatic movement of self-propelled satellite bogie 30 can be assured by a radio remote control for propelling the satellite bogie into, and from, storage station 31 and front end 32 of machine frame 8.

In the illustrated embodiment, guide rails 43 are provided at front end 32 of machine frame 8 and ramp track 42 is retractible into, and extendable from, front end 32 of machine frame 8, the ramp track having one end detachably connected to guide rails 43 and an opposite end arranged to be placed on track 5 of the uncorrected track section, when extended, the extended ramp track and guide rails enabling the self-propelled satellite bogie to be propelled into and from the front end of the machine. In this manner, a ramp may be rapidly mounted for moving the satellite bogie into and out of the machine frame while it may be as readily dismantled. As best shown in FIGS. 1 and 3, tunnel 33 in front end 32 of machine frame 8, which has a cross section enabling satellite bogie 30 to move to and from storage station 33, is defined by two lateral walls 37 and roof 38, and front door 35 is mounted on the roof for pivoting by pivoting cylinder 39 about transversely extending axis 36 between a position opening the tunnel for permitting the bogie to pass therethrough (as shown in FIG. 1) and a position closing the tunnel. Winch 45 driven by drive 44 is mounted at the rear of storage station 31 and cable 46 of the winch is detachably connectable to bogie 30 for holding the bogie. Guide roller or pulley 47 is mounted at the forward edge of front end 32 for guiding the cable without friction when it is connected to the bogie as the same is propelled forwardly.

As best shown in FIGS. 3 and 4, the illustrated embodiment of satellite bogie 30 is L-shaped, a vertical leg of the L-shape being constituted by an operator's cab 49 and a horizontal leg of the L-shape being constituted by platform 50 extending perpendicularly to cab 49. Another operator's cab 51 is mounted on front end 32 of machine frame 8 of car 6 in tunnel 33 and is laterally offset with respect to cab 49 of the bogie and at a level high enough to enable the platform of the L-shaped bogie to pass by cab 51 on the front end of the machine frame. Cab 51 is mounted on carrier plate 52 cantilevered to one of the side walls 37. Pivotal front door 35 includes a window and control panel 34 for operator's cab 51.

This configuration of the satellite bogie enables the bogie to be equipped with its own cab and to provide another cab at the front end of car 6 while still enabling the bogie to be moved into and out of the car. Since platform 50 of the bogie subtends carrier plate 52 for cab 51 in the car, no further manipulation is needed to enable the bogie to pass. The pivotal door at the front end of the car carries the control panel for cab 51 so that, when it is closed, the operator in cab 51 is in a position to do his work.

Forward track sensor 7 is mounted below cab 51 on carrier plate 53 whereon horizontal spindle drive 54 and two vertical spindle drives 55 are arranged. As indicated by the double-headed arrows, these drives enable laser beam receivers 23 and 24 attached to the forward ends of measuring chords 20 and 21 to be displaced horizontally and vertically, respectively.

As shown in FIGS. 1 and 4, means 56 for measuring a distance from fixed points 68 on poles 67 arranged laterally of track 5 of the uncorrected track section is mounted on bogie 30 in the rear range of the bogie in the operating direction and laser beam emitter means 57 is connected therewith. In the illustrated embodiment, distance measuring means 56 comprises laser beam emitter and receiver 69 for touchlessly measuring the distance whereby the deviations are determined, the laser beam emitter and receiver having coincidental optical axes 70 extending in a plane extending perpendicularly and transversely to the track. The structure and operation of such means has been more fully described in U.S. Pat. No. 4,490,038.

In the illustrated embodiment, vertically adjustable wheel axle 63 for sensing the track in the uncorrected track section is coupled to an end of satellite bogie 30 facing front end 32 of machine frame 8 by hydraulic cylinder 64 for raising the wheel axle from the operating position shown in FIG. 4 to a transfer position indicated in the stored position of the bogie in FIG. 1. Laser beam emitter means 57 and distance measuring laser beam emitter and receiver 59 are arranged on wheel axle 63, and they are connected for common vertical and lateral adjustment. For this purpose, laser beam emitter means 57 is mounted on horizontal spindle drive 58 driven by drive 59 for lateral adjustment, distance measuring means 56 being connected to means 57 for common displacement therewith. Spindle drive 58, in turn, is displaceably mounted on vertical spindle drives 60 driven by drives 61 for vertical adjustment. The vertical spindle drives are affixed to carrier plate 62 supported on wheel axle 63. With this arrangement, the vertical and lateral adjustment of distance measuring means 56 with respect to a fixed point alongside the track automatically assures the desired displacement of laser beam emitter means 57 into a position indicating the desired track level and line. The vertical adjustability of the wheel axle supporting this arrangement makes it possible to lift the very sensitive laser beam devices off the track when bogie 30 is moved into or out of car 6.

Double-acting hydraulic jack 65 enables a selected one of the wheels of wheel axle 63 to be pressed against a reference rail 3. The bogie runs on undercarriages 48 wherebetween an additional wheel axle 66 is arranged for measuring the cross level of the track.

As schematically indicated by chain-dotted lines 71, 72, laser beam emitter means 57 has an optical system for emitting a laser beam in a horizontal plane and a laser beam in a vertical plane, the horizontal beam plane being used for determining the correct level and the vertical beam plane being used for lining the track. Means 74 on bogie 30 is designed to store the measuring data, and radio means on control panel 34 of cab 51 on machine frame 8 is designed for remote control of the distance measuring, measuring data storing and laser beam emitter means. The remote controlled satellite bogie 30 with its own operator's cab and touchless distance measuring means connected to the laser beam emitter means provides a very accurate measurement and high efficiency since the laser beam emitter means, which provides a reference line for machine 1, can be brought rapidly and without physically touching the fixed points alongside the track in a desired position determined by the map of the track. Using a laser beam for this purpose avoids any interference by stray light and may be used also in the dark. Furthermore, such a satellite bogie may readily fit into the interior of a track measuring and recording car while, at the same time, accommodating all the measuring instrumentation required for accurate measurements so as to assure the highest efficiency. The remote control of this instrumentation by an operator of car 6 avoids any misunderstandings in communication and thus further increases the reliability of the machine.

The operation of the machine will partly be obvious from the above description of its structure and will be described hereinafter in detail. An existing track ordinate is automatically and continuously compared with a desired track ordinate and a track level is measured in the following manner:

Track measuring and recording car 6 with satellite bogie 30 positioned in storage station 31 inside the car is moved to the section of the track to be surveyed while the machine operator sits in cab 51 in front of control panel 34 to operate the machine. After the machine 1 has arrived at this track section, the operator actuates pivoting cylinder 39 to open pivotal front door 35. Ramp track 42 is now pulled out of storage station 31 through the opened front end of machine frame 8, the front ends of the rails of the ramp track, which have shoes for engagement with rails 3 of track 5, are placed on the track rails and the rear ends of the ramp track rails are attached to guide rails 43 inside the machine frame front end by quick-release fasteners. Radio remote control 73 is detachably placed on control panel 34 and, before the operator pivots front door 35 into the open position, he takes this radio remote control off the control panel and he then uses the radio remote control to propel satellite bogie 30 out of front end 32 of machine frame 8 down ramp track 42 onto the uncorrected track section until it has reached an extended distance from the machine frame front end, marked by a fixed point 68 alongside track 5, as shown in FIG. 2, where the bogie is stopped. Distance measuring laser beam emitter and receiver 69 together with laser beam emitter means 57 is now operated by remote control until coincident optical axes 70 of the laser beam emitter and receiver are focussed on fixed point 68 alongside the extended uncorrected track section, which is marked on a map of the track, and the vertical and lateral distance of the uncorrected track section from the fixed point has thus been determined. If a deviation from the desired value according to the track map, which is fed into control 74, is detected by the control, it will automatically correct the position of connected laser beam emitter means 57 to assume the desired position determined by the track map by operating drives 59 and/or 61 of spindle drives 58 and 60. In this desired position, horizontal laser beam plane 71 extends exactly parallel to the desired level of the track and vertical laser beam plane 72 extends exactly parallel to the chord of the track noted in the desired track position on the track map, which causes associated laser beam receiver means 23, 24 on machine frame 8 receiving the laser beams from laser beam emitter means 57 on bogie 30 to be moved and focussed while the bogie is stopped. Since the front ends of leveling and lining reference lines 20 and 21 are attached to the laser beam receiver means, they are automatically brought into the desired vertical and lateral position. After bogie 30 is moved onto track 5, ramp track 42 is detached and retracted back into the interior of car 6, where it may be stored in storage station 31, and the operator in cab 51 closes front door 35 so that he has control panel 34 before him to advance machine frame 8 continuously towards the bogie stopped at fixed point 68, during which forward movement receivers 26 and 27 on respective track sensors 7 will respectively exactly determine any deviation of the track level from the desired track level and the ordinate of desired track position 75 to obtain measuring data indicating the same (see FIG. 2). To establish the exact distance of satellite bogie 30 from machine 1 or its foremost track sensor 7, one of the bogie's undercarriages 48 carries odometer 77. The continuously obtained measuring data are compared in device 14 with comparative data stored on a magnetic tape provided by the railroad to indicate the desired data, and the ascertained differential values are stored in memory 15, with an indication of the corresponding mileage. After the machine frame has approached bogie 30, the bogie is propelled forwardly again to the next fixed point (shown in dash-dotted lines in FIG. 2) by remote control of drive 40 and the described steps are repeated until the entire extended track section has been measured. After the measurement of the extended uncorrected track section has been completed, the front door is pivoted into the open position again, ramp track 42 is extended into engagement with track 5 and bogie is propelled by remote control back into the front end of the machine frame. If desired and instead of being propelled by drive 40 back to storage station 31, satellite bogie 30, with its wheel axle 63 carrying the laser beam instrumentation 56 and 57 lifted off the track, the bogie may be connected to the end of cable 46 just before it reaches ramp track 42, and drive 44 of winch 45 is operated to pull the bogie over the ramp track and guide rails 43 into storage station 31. The ramp track is then detached and retracted, front door 35 is pivoted into its closed position and car 6 is ready to be moved over the track.

The data stored in memory 15 constitute the basis for evaluating the track condition and may be used in the controls of a track leveling, lining and tamping machine for correcting extended uncorrected track sections.

If desired, particularly under difficult operating conditions, the automatic drive of satellite bogie 30 as well, if necessary, the focussing on a respective fixed point 68 may be effected by an operator in cab 49 of the bogie.

What is claimed is:

1. A mobile machine for measuring the position of a track and arranged for mobility on the track in an operating direction, which comprises (a) a machine frame having a front end in the operating direction, (b) track reference measuring systems on the machine frame for determining different track parameters including the vertical and lateral position of the track, the track reference measuring systems for determining the vertical and lateral track position including (1) a laser beam receiver means on the machine frame front end, and (c) a self-propelled satellite bogie preceding the machine frame front end in the operating direction for mobility on an uncorrected section of the track in said direction, the bogie being equipped with (1) a drive for propelling the bogie in said direction and (2) a laser beam emitter means emitting a laser beam extending in at least one plane and projecting the laser beam on the receiver means for continuously determining any deviations in an extended uncorrected track section from a desired one of said positions, (d) the front end of the machine frame being arranged for receiving the satellite bogie and having a storage station whereinto, and wherefrom, the satellite bogie may be propelled, and (e) the satellite bogie being constructed for being automatically propelled into, and from, the storage station and the front end of the machine frame.

2. The mobile track position measuring machine of claim 1, further comprising means on the machine frame for comparing the deviations with the desired positions to obtain track measuring data and data storage means on the machine frame for recording the track measuring data.

3. The mobile track position measuring machine of claim 1, wherein the front end of the machine frame defines a tunnel having a cross section corresponding at least to the cross section of the satellite bogie for receiving the satellite bogie and enabling the satellite bogie to move through the tunnel to and from the storage station.

4. The mobile track position measuring machine of claim 1, wherein the track reference measuring systems comprise sensors for determining respective ones of the track parameters including track level, line, twist, gage and cross level, the machine being a track measuring car.

5. The mobile track position measuring machine of claim 1, further comprising a radio remote control for automatically propelling the satellite bogie into, and from, the storage station and the front end of the machine frame.

6. The mobile track position measuring machine of claim 1, wherein the satellite bogie is equipped with a laser beam emitter and receiver for touchlessly measuring the distance of the uncorrected track section from fixed points positioned alongside the uncorrected track section whereby the deviations are determined, the laser beam receiver and emitter having coincident optical axes extending in a plane extending perpendicularly and transversely to the track.

7. The mobile track position measuring machine of claim 6, further comprising a vertically adjustable wheel axle for sensing the track in the uncorrected track section, the wheel axle being coupled to an end of the satellite bogie facing the front end of the machine frame, the laser beam emitter means and distance measuring laser beam emitter and receiver being arranged on the wheel axle, and the laser beam emitter means and the distance measuring laser beam emitter and receiver being connected for common vertical and lateral adjustment.

8. The mobile track position measuring machine of claim 1, further comprising guide rails at the front end of the machine frame and a ramp track retractible into, and extendable from, the front end of the machine frame, the ramp track having one end detachably connected to the guide rails and an opposite end arranged to be placed on the track of the uncorrected track section, when extended, the extended ramp track and guide rails enabling the self-propelled satellite bogie to be propelled into and from the front end of the machine.

9. The mobile track position measuring machine of claim 1, further comprising an operator's cab on the self-propelled satellite bogie, means on the bogie for measuring a distance from fixed points arranged laterally of the track of the uncorrected track section to obtaining measuring data, means on the bogie for storing the measuring data, and radio means on the machine frame for remote control of the distance measuring, measuring data storing and laser beam emitter means.

10. The mobile track position measuring machine of claim 9, wherein the satellite bogie is L-shaped, a vertical leg of the L-shape being constituted by the cab and a horizontal leg of the L-shape being constituted by a platform extending perpendicularly to the cab, and further comprising another operator's cab mounted on the front end of the machine frame laterally offset with respect to the cab of the bogie and at a level high enough to enable the platform of the L-shaped bogie to pass by the cab on the front end of the machine frame.

11. The mobile track position measuring machine of claim 10, wherein the front end of the machine frame defines a tunnel having a cross section corresponding at least to the cross section of the satellite bogie for receiving the satellite bogie and enabling the satellite bogie to move through the tunnel to and from the storage station, the tunnel having a roof, and further comprising a front door mounted on the roof for pivoting about a transversely extending axis between a position opening the tunnel for permitting the bogie to pass therethrough and a position closing the tunnel, and the pivotal front door including a window and a control panel for the other operator's cab.

12. A method for automatically and continuously comparing an existing track ordinate with a desired track ordinate and for measuring a track level by operating a mobile machine for measuring the position of a track and arranged for mobility on the track in an operating direction, comprising a machine frame having a front end in the operating direction, track reference measuring systems on the machine frame for determining different track parameters including the vertical and lateral position of the track, the systems for determining the vertical and lateral track position including a laser beam receiver means on the machine frame front end, and a self-propelled satellite bogie preceding the machine frame front end in the operating direction for mobility on an uncorrected section of the track in said direction, the bogie being equipped with a drive for propelling the bogie in said direction, a laser beam emitter means emitting a laser beam extending in at least one plane and projecting the laser beam on the receiver means for continuously determining any deviations in an extended uncorrected track section from a desired one of said positions, and a laser beam emitter and receiver for touchlessly measuring the distance of the uncorrected track section from fixed points positioned alongside the uncorrected track section whereby the deviations are determined, the laser beam receiver and emitter having coincident optical axes extending in a plane extending perpendicularly and transversely to the track, the front end of the machine frame being arranged for receiving the satellite bogie and having a storage station whereinto, and wherefrom, the satellite bogie may be propelled, and the satellite bogie being constructed for being automatically propelled into, and from, the storage station and the front end of the machine frame, which method comprises the steps of (a) propelling the satellite bogie out of the front end of the machine frame onto the uncorrected track section until it has reached an extended distance from the machine frame front end, (b) operating the distance measuring laser beam emitter and receiver together with the laser beam emitter means by remote control until the laser beam emitter and receiver has been focussed on a respective one of the fixed points alongside the uncorrected track section, (c) receiving the laser beams emitted by the laser beam emitter means on the bogie while the bogie is stopped and thereby focussing the laser beam receiver means on the machine frame, and continuously advancing the machine frame towards the stopped bogie to obtain measuring data indicating the ordinate and the level, (d) comparing the continuously obtained measuring data with comparative data indicating the desired data and storing the ascertained differential values, (e) propelling the stopped bogie forwardly after the machine frame has approached the bogie and repeating steps (b), (c) and (d), and (f) propelling the bogie by remote control back into the front end of the machine frame after the measurement of the extended uncorrected track section has been completed.

* * * * *